United States Patent [19]

Consaga

[11] 4,214,928

[45] Jul. 29, 1980

[54] DIMETHYL HYDANTOIN BONDING AGENTS IN SOLID PROPELLANTS

[75] Inventor: John P. Consaga, Waldorf, Md.

[73] Assignee: The United States of America as represented by the Secretary of the Navy, Washington, D.C.

[21] Appl. No.: 745,519

[22] Filed: Nov. 29, 1976

Related U.S. Application Data

[63] Continuation-in-part of Ser. No. 514,332, Oct. 9, 1974, abandoned.

[51] Int. Cl.[3] ..... C06B 45/10

[52] U.S. Cl. ..... 149/19.9; 149/19.1; 149/19.4; 149/19.6

[58] Field of Search ..... 260/309.5; 149/19.1, 149/19.4, 19.6, 19.9

[56] References Cited

U.S. PATENT DOCUMENTS

| | | | |
|---|---|---|---|
| 3,278,352 | 10/1966 | Erickson | 149/19.5 |
| 3,449,353 | 6/1969 | Porret et al. | 260/309.5 |
| 3,631,221 | 12/1971 | Batzer et al. | 260/309.5 |
| 3,734,786 | 5/1973 | Walden et al. | 149/19.92 |
| 3,790,416 | 2/1974 | Dehan | 149/19.6 |
| 3,801,385 | 4/1974 | Mastrolia et al. | 149/19.9 |
| 3,834,957 | 9/1974 | McDevitt et al. | 149/19.9 |
| 3,843,675 | 10/1974 | Porret et al. | 260/309.5 |
| 3,894,038 | 7/1975 | Habermeier et al. | 260/309.5 |

*Primary Examiner*—Edward A. Miller

*Attorney, Agent, or Firm*—R. S. Sciascia; A. L. Branning; H. B. Field

[57] ABSTRACT

A dimethyl hydantoin bonding agent is incorporated into a propellant system so as to interact with and bond various filler materials into a cured binder system.

7 Claims, No Drawings

DIMETHYL HYDANTOIN BONDING AGENTS IN SOLID PROPELLANTS

BACKGROUND OF THE INVENTION

This application is a continuation-in-part of copending application Ser. No. 514,332, filed Oct. 9, 1974, now abandoned.

This invention relates to cured synthetic resin binders and more specifically to filled, cured, synthetic resin binders utilizing a dimethyl hydantoin compound to produce a binder-filler interaction.

It is well known in the art that cured binders may contain fillers which modify the properties of the system. It is desired that the binder adhere to the fillers strongly and form an interaction. One way to achieve the interaction is for the resin to wet the filler. Wetting of the filler is especially suitable, because fillers are customarily incorporated in a resin by mixing the filler with a liquid prepolymer and curing the mixture to form a cured binder. For example, in the curing process wherein the filler is a special type of filler known as an oxidizer, vacuoles may exist between the surface of the oxidizer and the cured binder. Such swelling implies a weakness of the bond between the resin and the oxidizer particle. Also, the bond between the binder and the filler breaks when the binder is flexed. The strain caused by the flexing of the binder produces voids in the resin that breaks the bond of the resin to the filler. The production of these voids is known as dewetting or blanching. The dewetting of one particle puts the other particles under stress, thereby propagating the dewetting phenomenon. A more thorough description of the resin-filler relationship is found in "Principle of Strength Reinforcement in Filled Rubbers" by A.E. Oberth in *Rubber Chemistry and Technology,* Volume 40 No. 5, December 1964, pages 1337–1363, incorporated herein by reference.

To solve these problems of dewetting and blanching, bonding agents are added to binder and filler compositions. These bonding agents become tied to the polymer backbone of the cured binder, especially the binder which serves in a propellant or explosive, and function in a variety of ways. The bonding agent may homopolymerize around the filler thereby adsorbing on or coating the filler. Yet this reaction does not prevent dewetting. Another function of the bonding agent, especially when used with an oxidizer, is to chemically react and generate ammonia in an ammonium perchlorate oxidizer system to provide a good bond between the binder and the filler. Yet another function of a bonding agent is to form a chemical complex between the filler and the binder. However, at present no bonding agents are known which work with cyclotetramethylene tetranitramine and cyclotrimethylene trinitramine systems. A desirable bonding agent must form interactions between the filler and the binder. This bonding agent must also be suitable for use with a wide variety of binders and fillers, in order to simplify processing. Additionally, safety in processing is required.

Many bonding agents are known in the art. However, no prior art bonding agent meets, the requirements fully. Known bonding agents include cyanoamine based material such as 2,3-dihydroxypropyl bis-2-cyanoethyl amine of the formula $$\underset{\underset{OH}{|}}{CH_2}-\underset{\underset{OH}{|}}{CH}-CH\,(CH_2-CH_2CN)_2;$$

MAPO based bonding agent wherein MAPO is methyl aziridinal phosphine oxide; or ethanol amines based such as cyclohexyldiethanolamine.

For example, the cyanoamine-based materials are very basic and generate ammonia during mixing with the resin. Fumes from the ammonia are toxic and, therefore, dangerous. The cyanoamines also dry the mix, require longer mixing times, and have a solubility limitation. MAPO being trifunctional provides undesirable branch points or cross-linking and, in addition, causes the dewetting phenomenon. The ethanolamine-based materials also given softer propellants.

One special type of filled resin is an explosive or a propellant. Common explosive substances such as cyclotrimethylenetrinitramine (hereafter RDX), and cyclotetramethylenetetranitramine (hereafter HMX) are not bound in the binder by use of common bonding agent. Thus, when oxidizers are combined as fillers with a binder in order to form the special type of filled resin known as an explosive or a propellant, prior art bonding agents do not always prevent dewetting in the new propellant or explosive. Propellant when used hereafter also includes explosives.

One particularly suitable binder is hydroxyl terminated polybutadiene. But propellants containing this binder have problems which overcome the low cost and low viscosity advantages of this polymer. The hydroxyl terminated polybutadiene propellants have a short pot-life, poor processibility, low and nonstoichiometric isocyanate to hydroxyl curing ratios, dewetting, poor mechanical properties, and a high burning rate slope. Prior art bonding agents have not overcome these deficiencies. Thus it may be seen that a new bonding agent is required.

SUMMARY OF THE INVENTION

Therefore, it is an object of this invention to provide a method for bonding a filler in a cured binder.

It is a further object of this invention to provide a method for bonding a filler in a binder having application to a large number of binders and fillers.

It is a still further object of this invention to provide a method for bonding potassium perchlorate in a binder.

Another object of this invention is to provide a method for bonding ammonium nitrate in a binder.

Yet another object of this invention is to provide a method for bonding ammonium perchlorate in a binder.

Also it is an object of this invention to provide a method for bonding a mixture of oxidizers in a binder.

It is a still further object of this invention to provide a method for bonding HMX in a binder.

Another object of this invention is to provide a method for bonding RDX in a binder.

Yet another object of this invention is to provide a composition comprising a filled binder having a filler strongly bound therein.

It is a still further object of this invention to provide a filled binder having the filler strongly bound therein suitable for use as a propellant.

These and other objects of the invention are met by using in the cured binder, propellant or explosive, a bonding agent of a dimethyl hydantoin to bond the filler therein.

DESCRIPTION OF THE PREFERRED EMBODIMENTS

A class of bonding agents which provides a means for interacting a filler with a resin to form a composition is the hydantoins. The hydantoins are also suitable for bonding an explosive substance which is a special filler known as an oxidizer in resins in order to form a special type of composition known as a composite propellant. The basic structure of the hydantoin contains an imide-amide-urea structure as shown below.

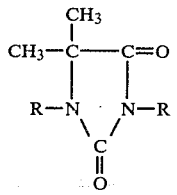

where R can be $-CH_2CH_2OH$,

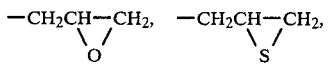

$-CH_2CH{=}CH_2$, $-CH_2CH_2CO\,OH$, or

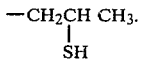

Selection of R is based on the binder and the reactability of R therewith. The R functional group on the hydantoin must be reactive or compatible with, and is preferably the same as the functional group on the binder.

The hydantoin is usually a dimethyl hydantoin which is suitable for use in a number of binder-filler compositions. The bonding agent improves the interaction between the binder and the filler in such a way; that when the binder and the special filler known as an oxidizer are combined to form a propellant and the propellant is flexed, the oxidizer does not "pop" out of the binder. Visual evidence of these properties is found by using a scanning electron microscope. The hydantoin bonding agent results in stringy beads of the binder coating the particles, and indicates a strong interaction between the binder and the filler. Without the bonding agent, it is possible to remove oxidizer particles from a propellant with a needle or by flexing the propellant. No fracturing of the oxidizer crystal is required to remove the oxidizer when the bonding agent is not used. Suitable hydantoins include those of U.S. Pat. No. 3,449,353 to Porret et al incorporated herein by reference to disclose a means of making any hydantoins used in this invention.

The wide variety of polymers useful as binders for propellants, or as filled resins generically have the desired properties of processibility and utility in propellants or explosives, generally have a molecular weight of less than 10,000, and a viscosity of between about 20 and about 500 poise. Suitable polymers include: epoxy terminated polybutadiene, carboxyl terminated polybutadiene, hydroxyl terminated polybutadiene, mercaptyl terminated polybutadiene, episulfide terminated polybutadiene, epoxy terminated polyether, carboxyl terminated polyether, hydroxyl terminated polyether, mercaptyl terminated polyether, episulfide terminated polyether, and liquid copolymer systems such as polybutadiene-styrene and polybutadiene-acrylonitrile having functional groups which include, epoxy terminal groups, carboxyl terminal groups, hydroxyl terminatal groups, mercaptyl terminal groups and episulfide terminal groups. A preferred prepolymer useful for making a propellant desired by this invention is R45M available from ARCO, Inc., which is a hydroxyl terminated polybutadiene having a molecular weight of about 3300, a viscosity of about 50 poise, and a functionality of 2.6.

The dimethyl hydantoin (DHE) compound is especially useful for bonding oxidizers in composite propellants or explosives. While not intending to be bound by any particular theory, it is postulated that the dimethyl hydantoin functions as a bonding agent by complexation while explains its use with a wide variety of binders and fillers. For example, with HMX and RDX, the hydantoin is believed to form a complex, with the complex being amendable to bonding in the binder. The hydantoin is believed to be the only bonding agent known at this time for bonding HMX or RDX in a composite propellant or explosive. Up to about 5% hydantoin is suitable with 0.3% to 0.7% hydantoin by propellant weight preferred.

Of the many known oxidizers only a few are compatible with binder systems using a hydantoin bonding agent. Cyclotrimethylene trinitramine (RDX) and cyclotetramethylene tetranitramine (HMX) are strongly bound in binders using hydantoin bonding agent. A complexing reaction is believed to account for the strong bond. Ammonium perchlorate, ammonium nitrate, and potassium perchlorate are also strongly bonded in a binder by using dimethyl hydantoin bonding agent. It is also possible to use mixtures of oxidizers in the binder as well as various fuels and propellant adjuvants.

Compositions using the dimethyl hydantoin as a bonding agent are also easier to work with in casting, molding, extruding or mixing processes. Solubility of the hydantoin in polymer causes no problem. The hydantoin also functions as a hardener. Mechanical properties at low temperatures are also improved.

The composition usually comprises 10% to 25% binder, 75% to 90% oxidizer, and up to 5% bonding agent.

The following examples are intended to illustrate without unduly limiting the scope of the invention. All parts and percentages are by weight of the total composition unless otherwise specified.

EXAMPLE I

Two propellants using the same hydroxyl terminated polybutadiene binder and ammonium perchlorate oxidizer are prepared in a standard fashion. About 20% binder, 79.5% oxidizer, and 0.5% bonding agent are used. The only non-identical point about the two propellants is that propellant "c" used cyclohexyl diethanol amine as a bonding agent and propellant "d" used di(2-hydroxyethyl) dimethyl hydantoin. Propellant "c" had a hardness of 75, and propellant "d" had a hardness of 82. The nine percent increase in hardness for propellant "d" is attributed di(2-hydroxyethyl) dimethyl hydantoin.

EXAMPLE II

Small quantities of di(2-hydroxyethyl) dimethylhydantoin (DHE) (0.3 to 0.7% are incorporated into a hydroxyl terminated polybutadiene (HTPB), propellant filled with RDX and HMX respectively as set forth in Example I. For comparison propellants are also made without any bonding agent with both oxidizers. In these cases without the bonding agent, it is possible to remove HMX and RDX crystals from the propellant with a needle, which indicates little if any binder-filler interaction. However, when DHE was employed, the oxidizer crystals are not removed readily without fracturing. The bonding phenomenon is further investigated by scanning electron microscopy. Photographs of fractured surfaces of the propellants confirms the preliminary investigation. When DHE is missing from the propellant formulation, valleys or crevices around the oxidizer particles are evident, the oxidizer particles are evident, and the oxidizer particles are smooth instead of coated with the binder. On the other hand, when the bonding agent is employed, the crevices or valleys did not appear around the oxidizer particles and stringy beads of the binder are observed coating the particles, thus indicating a strong interaction between the binder and the filler.

Obviously, numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. In combination with a composition which is selected from the group consisting of a propellant and an explosive and wherein said composition comprises a polymeric binder selected from the group consisting of epoxy terminated polybutadiene, carboxyl terminated polybutadiene, hydroxyl terminated polybutadiene, mercaptyl terminated polybutadiene, episulfide terminated polybutadiene, epoxy terminated polyether, carboxyl terminated polyether, hydroxyl terminated polyether, mercaptyl terminated polyether, episulfide terminated polyether, and liquid copolymer systems selected from the group consisting of polybutadiene-styrene and polybutadiene-acrylonitrile having functional groups selected from the group which consists of epoxy terminal groups, carboxyl terminal groups, hydroxyl terminatal groups, mercaptyl terminal groups, and episulfide terminal groups, and an oxidizer selected from the group consisting of ammonium nitrate, potassium perchlorate, ammonium perchlorate, cyclotetramethylene tetranitramine (HMX) and cyclotrimethylene trinitramine (RDX), wherein the improvement comprises:

means for preventing dewetting of said composition by the addition of a dimethylhydantoin bonding agent of the formula

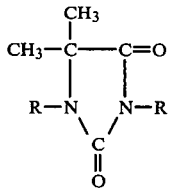

wherein R is selected from the group consisting of —$CH_2CH_2OH$,

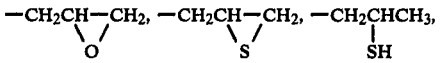

—$CH_2CH{=}CH_2$, and —$CH_2CH_2COOH$ and wherein, said bonding agent prevents dewetting by complexing with said binder and said oxidizer.

2. The composition of claim 1 wherein R is —$CH_2CH_2OH$.

3. The composition of claim 2, wherein the oxidizer is selected from the group consisting of cyclotetramethylene tetranitramine and cyclotrimethylene trinitramine.

4. The composition of claim 2 wherein the oxidizer is selected from the group consisting of ammonium perchlorate or potassium perchlorate.

5. A composition being selected from the group consisting of a propellant and an explosive, comprising:

a polymeric binder selected from the group consisting of epoxy terminated polybutadiene, carboxyl terminated polybutadiene, hydroxyl terminated polybutadiene, mercaptyl terminated polybutadiene, episulfide terminated polybutadiene, epoxy terminated polyether, carboxyl terminated polyether, hydroxyl terminated polyether, mercaptyl terminated polyether, episulfide terminated polyether, and liquid copolymer systems selected from the group consisting of polybutadiene-styrene and polybutadiene-acrylonitrile having functional groups selected from the group which consists of epoxy terminal groups, carboxyl terminal groups, hydroxyl terminal groups, mercaptyl terminal groups, and episulfide terminal groups;

an oxidizer selected from the group consisting of ammonium nitrate, potassium perchlorate, ammonium perchlorate, cyclotrimethylene trinitramine and cyclotetramethylene tetranitramine; and a dimethylhydantoin bonding agent of the formula

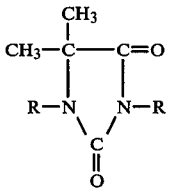

wherein R is selected from the group consisting of —$CH_2CH_2OH$,

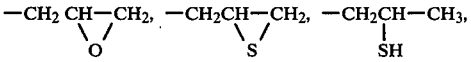

—$CH_2$—$CH{=}CH_2$, and —$CH_2CH_2COOH$.

6. The composition of claim 5 wherein the binder comprises 10% of 25%, the oxidizer comprises 75% to 90%, and the agent comprises up to 5% all percentages being based on the weight of the propellant.

7. The composition of claim 5 wherein the binder is hydroxyl terminated polybutadiene.

* * * * *